United States Patent [19]

Butler

[11] 4,189,300

[45] Feb. 19, 1980

[54] ROTATING DRUM DRYER APPARATUS

[75] Inventor: Theodore G. Butler, Orlando, Fla.

[73] Assignee: Mechtron International Corporation, Orlando, Fla.

[21] Appl. No.: 937,041

[22] Filed: Aug. 28, 1978

[51] Int. Cl.[2] ..... F27B 7/14

[52] U.S. Cl. ..... 432/118; 34/135; 432/105

[58] Field of Search ..... 432/105, 118; 34/135, 34/136, 137

[56] References Cited

U.S. PATENT DOCUMENTS

| | | | |
|---|---|---|---|
| 856,770 | 6/1907 | Cummer | 34/135 |
| 3,950,861 | 4/1976 | Weimer et al. | 432/118 |

FOREIGN PATENT DOCUMENTS

| | | | |
|---|---|---|---|
| 1300069 | 7/1964 | Fed. Rep. of Germany | 432/118 |
| 69906 | 8/1915 | Switzerland | 432/118 |

*Primary Examiner*—John J. Camby

*Attorney, Agent, or Firm*—Duckworth, Hobby, Allen & Pettis

[57] ABSTRACT

A burner and associated rotating drum dryer for drying loose material, such as aggregates, is provided in which the burner directs a flame into the middle of the dryer drum, which has flights therein which lift the loose material in the rotating drum and drop it to either side of the center of the flame while preventing its falling through the center. A plurality of flights are mounted around the drum and each captures loose material as it passes through the loose material on the bottom of the drum and drops the material in a pattern in the drum for more rapid drying of the material. The material is spread through the open space of the drum except for that portion in the middle of the flame so as not to interfere with complete combustion.

8 Claims, 4 Drawing Figures

ROTATING DRUM DRYER APPARATUS

BACKGROUND OF THE INVENTION

The present invention relates to rotary drum dryers and especially to rotary drum dryers connected to burners which are used to dry bulk loose materials such as aggregates, and the like.

In the past, it has been common to dry a wide variety of loose materials in large rotating drums. In a typical dryer, a burner which might work on a gas, oil or finely powdered coal might have a blower directing air through the burner for mixing with fuel metered by valves and/or nozzles. The flame is directed in a refractory lined combustion chamber which is open to the drum dryer so that the material being rotated and dispersed in the dryer drum does not interfere with the burner flame and so that the material does not become coated with oil or black carbon by falling through the flame before combustion is complete. The refractory lined combustion chambers, however, are expensive and it is difficult to replace the linings, and in prior systems the flights were attached to the inside of the drum for lifting the material from the bottom as the drum rotated and letting it fall through the air as the heated air passed through the drum to effect a more rapid drying of the material. Flights were designed to distribute the material throughout the interior space of the drum and in a pattern to make the drying as effective as possible. The present invention, on the other hand, is directed towards a flight that distributes the loose material in a drying drum in a pre-determined pattern covering all of the drum except the middle portion where the flame is being directed into the drum. This allows for the elimination of the refractory lined combustion chamber which can accept the high heat of the burner and at the same time prevent the falling material from interfering with the flame and thereby preventing full combustion of the fuel. The loose material also does not become coated with oil or carbon black from falling through that portion of the flame in which there has not been complete combustion of the fuel.

SUMMARY OF THE INVENTION

The present invention relates to a rotating drum dryer and burner in which the burner is adapted to provide a flame having a pre-determined shape directly into the rotating drum dryer. The rotating drum has a hollow interior with a variety of flights mounted to the interior wall thereof. The flights are shaped to capture loose material in the bottom of the drum, and to distribute the material through the open space in the drum in an even pattern except for around the elongated axis of the cylindrical drum where the flame is directed, and to prevent loose material from falling through the center portion, so as to maintain the efficiency of the burning and to prevent the loose material from becoming coated with incomplete combustion products and waste fuel. Each flight may be shaped having a base plate protruding radially inward from the interior wall of the drum and having a channel portion attached to the end thereof forming an elongated pocket facing the interior wall of the drum with one side of the channel being extended with an angle to form a side pocket facing the support. This shape flight captures material from the bottom of the drum and distributes it except when directly over the center where the remaining material is held until it passes the drum's center portion and then begins to distribute loose material again.

BRIEF DESCRIPTION OF THE DRAWINGS

Further objects, features and advantages of the present invention will be apparent from the written description and the drawings, in which.

DESCRIPTION OF THE PREFERRED EMBODIMENT

Figure 1:
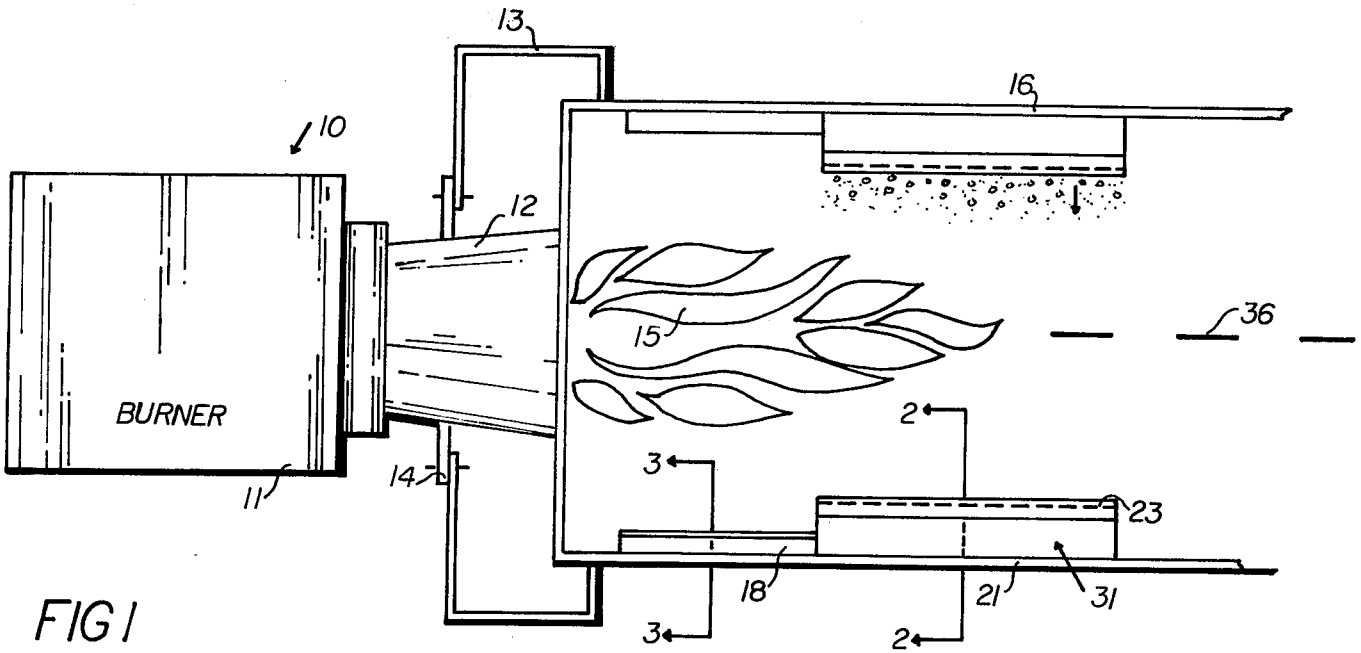
FIG. 1 shows a sectional view of a rotating drum dryer having a burner attached thereto and illustrating the path of the flame.
Figure 3:
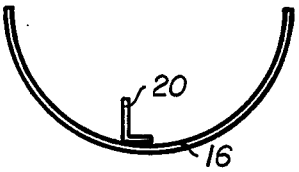
FIG. 3 is a sectional view taken on a line 3—3 of FIG. 1.

Referring now to FIG. 1 of the drawings, a rotating drum dryer 10 is illustrated having a burner 11 with a protruding burner quarl or port 12 passing through a dryer breeching portion 13 which has connectors 14 which may be opened or closed as desired. The burner quarl or port is a flame-shaping cone to produce the desired shape of the flame 15. The flame is shown protruding into an open-ended cylindrical drum 16, which is used for drying any loose material 17, such as an aggregate. The drum 16 has a plurality of flights 18, which may be elongated angle-iron members 20, as illustrated in FIG. 3, attached to the inside of the drum 16 kicking the aggregate material loose from the bottom 21 of the cylindrical drum 16.

Figure 2:
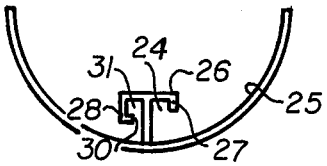
FIG. 2 is a sectional view taken on a line 2—2 of FIG. 1.
Figure 4:
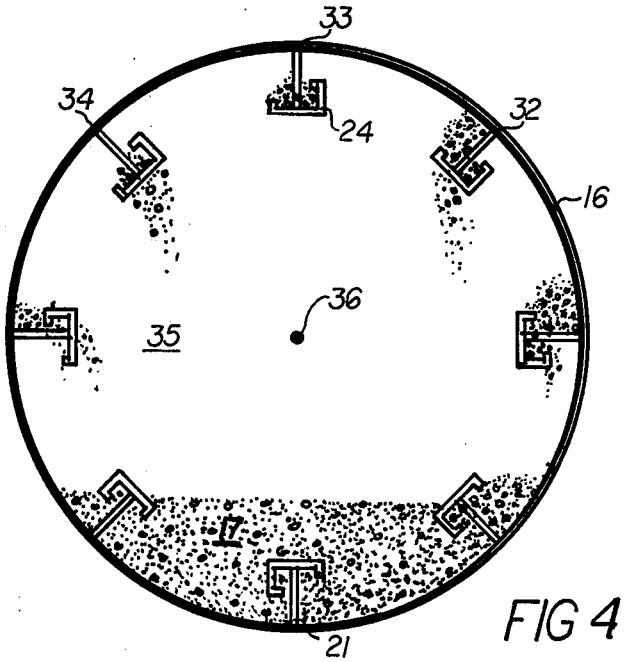
FIG. 4 is an end elevation showing the interior of the dryer drum distribution material during rotation.

Drum 16 also has a plurality of main flights 22, which are illustrated in FIGS. 2 and 4, having an elongated support plate 23 with this support plate having an elongated channel 26 attached perpendicular thereto, to form a pocket 24 attached to the support 22 facing the interior wall 25 of the drum 16. The channel 26 has one side 27 and a second side 28 with the side 28 being extended and having a lip 30 mounted thereagainst to form a second pocket 31 facing the radially extending base support 23. The main flight 22 is thus shaped as illustrated in FIG. 4 to capture loose material 17 in the bottom 21 of the drum 16 as the flight 22 moves therethrough and to let material captured thereby begin falling therefrom in a pattern as the drum 16 rotates in a counter-clockwise direction as illustrated in FIG. 4. The material continues to fall, as illustrated, starting from zero degrees at the bottom 21 to a point 32 which is approximately 135 degrees, at which point the design of the flight 22 holds the remaining material in the pockets 24 and 31, as the flight moves past the 180 degree (or twelve o'clock) point 33. In order for material to again drop from the pockets 24 and 31, the flight must reach a point 34, which is approximately 235 degrees from the zero point 21 when moving counter-clockwise. The flight 22 continues to rain the loose material through the open space of the drum 35 with the exception of that area around the elongated center axis 36, thereby drying the loose aggregate material but preventing it from falling through the flame 15, thereby interfering with complete combustion of the fuels and preventing the loose materials from becoming coated with oil or carbon black, or the like, from falling through the flame. This type of flight allows the elimination of the separate refractory lined combustion chamber between the burner quarl 12 and the rotating drum 16, with the necessary expensive use of refractory materials which have to be frequently replaced at great expense, while allowing an efficient drying of the loose material being dried. It should, of course, be clear at this point that a rotating drum dryer has been provided, having flights to prevent the interference with the flame of the burner. It should, however, be clear that other shaped flights can also be utilized without departing from the spirit and scope of the invention. Accordingly, the present invention is not to be construed as limited to the particular forms disclosed herein, which are to be regarded as illustrative rather than restrictive.

I claim:

1. A rotating drum dryer comprising in combination:

a burner adapted to provide a flame of predetermined shape;

a rotating drum dryer having a hollow interior positioned adjacent said burner in a position for said burner flame to be directed into an end thereof;

said rotating drum dryer having a plurality of flights fixedly attached to the interior walls thereof for rotating therewith, a plurality of said flights having means to capture loose material in said drum as said flights rotate through material accumulated in said drum below said burner flame and releasing a portion of the captured material in a pattern on one side of the burner flame through approximately 135 degrees of rotation of each flight on said drum beginning from below said burner flame and releasing a second portion of captured material on the other side of the burner flame; and said flights holding loose material therein during approximately 100 degrees of rotation of said dryer while passing over the center axis of said burner flame whereby loose material is prevented from falling into the center portion of the flame.

2. The apparatus in accordance with claim 1, in which said plurality of flights includes a plurality of kicker flights for kicking material loose from the bottom of said rotating drum dryer, each said kicker flight having at least one elongated member attached to the interior wall of said rotating drum dryer.

3. The apparatus in accordance with claim 2, in which each said flight has a base member attached to the interior wall of said drum and extending therefrom and a channel mounted on the end of said base member.

4. The apparatus in accordance with claim 2, in which said base member has at least two pockets mounted on the end thereof.

5. The apparatus in accordance with claim 3, in which said base member has a channel member having a base and two (2) arms and said channel member being mounted perpendicular to said base member across the end thereof and having a lip mounted to one said arm thereof.

6. The apparatus in accordance with claim 5, in which said base member extends radially from the interior of said drum.

7. The apparatus in accordance with claim 4, in which one said pocket is located on each side of said base member.

8. The apparatus in accordance with claim 5, in which said channel member is mounted perpendicular to said base member, having a pair of arms extending towards the interior surface of said drum, one said arm having an additional arm extending back toward said base member.

* * * * *